US007070547B1

(12) United States Patent
Pater

(10) Patent No.: US 7,070,547 B1
(45) Date of Patent: Jul. 4, 2006

(54) WEIGHT BENCH WITH DUMBBELL SUPPORTS

(76) Inventor: David Michael Pater, 28810 Corlan Rd. NE., Blackduck, MN (US) 56630

( * ) Notice: Subject to any disclaimer, the term of this patent is extended or adjusted under 35 U.S.C. 154(b) by 400 days.

(21) Appl. No.: 10/234,938

(22) Filed: Sep. 4, 2002

(51) Int. Cl.
*A63B 26/00* (2006.01)
*A63B 21/078* (2006.01)

(52) U.S. Cl. ..... 482/142; 482/104

(58) Field of Classification Search ..... 482/97, 482/100, 104, 142, 94–96, 143–147; 297/316, 297/320

See application file for complete search history.

(56) References Cited

U.S. PATENT DOCUMENTS 5,410,769 A * 5/1995 Waterman ..... 5/632
5,411,459 A * 5/1995 Hayden ..... 482/104
5,472,397 A * 12/1995 Ammoscato et al. ..... 482/104
5,665,038 A * 9/1997 Miller ..... 482/104
5,725,460 A * 3/1998 Marsh ..... 482/104
5,882,283 A * 3/1999 Stevens ..... 482/104
5,954,619 A * 9/1999 Petrone ..... 482/104
5,971,898 A * 10/1999 Schoolfield ..... 482/104
6,645,130 B1 * 11/2003 Webber ..... 482/142
6,709,370 B1 * 3/2004 Evans ..... 482/104

OTHER PUBLICATIONS

BODYMASTERS brochure insert, received 1994, pp. 1, 3.*

* cited by examiner

*Primary Examiner*—Gregory L. Huson
*Assistant Examiner*—Fenn C. Matthew

(57) ABSTRACT

The weight bench with dumbbell supports is a conventional weight bench that features two additional vertical supports that enable the bench to accommodate dumbbells. These supports would be produced from square metal tubing, but their bottoms would be angled for attachment to the exterior of the weight bench's existing vertical supports. Ultimately, each support would be welded to the exterior of the bench's vertical support, thereby creating a solid, one-piece support featuring a forked design on each side of the bench. The upper portion of each additional vertical support would feature a wide metal plate at its top. The ends of each plate would be angled upward to securely hold the end of a dumbbell. The dumbbell supports could also be offered as an aftermarket accessory for installation on existing weight benches.

2 Claims, 1 Drawing Sheet

WEIGHT BENCH WITH DUMBBELL SUPPORTS

BACKGROUND OF THE INVENTION

1. Field of the Invention

The present invention relates to a bench for use in connection with supporting free weights used in weight training associated with physical fitness. The weight bench with dumbbell supports has particular utility in connection with supporting both dumbbell and barbell style weights.

2. Description of the Prior Art

Fitness enthusiasts have recently returned to weightlifting as a popular method for their workouts. Weight training can be used to build muscular strength while increasing stamina since the lifter must both balance and lift weights mounted on opposite ends of a lifting bar, thereby exercising the entire cross sectional area of muscle. One of the most common and effective weightlifting techniques to increase overall muscle strength requires the weightlifter to repetitively lift a predetermined weight until his or her muscles have reached a point of nearly complete physical exhaustion. To avoid injuries during this procedure, it is a common safety practice to engage the assistance or a spotter or lifting partner whose function is to observe the weightlifter during the exercise program and provide assistance, if necessary, as the weight lifter approaches the point of failure or if the weightlifter loses control of the barbell. When a weightlifter includes dumbbells in his workout regimen, additional problems come in to play. If a spotter is not used, the dumbbells are typically lifted from the floor while the weightlifter is lying on a weight bench, causing undue strain on the shoulders, elbows, and wrists. Additionally, the weightlifting exercises must then be started from a lower than desirable position, again subjecting the various parts of the arms to undue pressure. Therefore, it would be advantageous to the weightlifter to have a weight bench which supported a similar starting position for both barbell and dumbbell weight exercises. This would allow the individual to perform more repetitions, thus enhancing the workout, and would reduce the risk of muscle strains and injuries, thereby enhancing safety. In addition, a bench that provided dumbbell supports would eliminate the need to ask another person for help when starting repetitions, allowing a fitness enthusiast to work out in a timesaving and efficient manner.

A wide variety of weightlifting exercises can be performed when dumbbells and barbells are combined with a multi-position weight bench. Some exercises are performed on a flat bench, some on an inclined bench, and some on a declined bench, wherein one part of the bench is angled downward toward the floor. Therefore, a weight bench which combines support for both dumbbells and barbells with a multi-positional bench would be beneficial to the individual involved in weight training. However, the majority of health clubs and private owners who currently own weight benches would be unwilling to spend the money to buy a new weight bench solely for the purpose of adding dumbbell supports to the facility. Thus, an apparatus which could be mounted on a variety of existing weight benches to hold dumbbells would be beneficial in the weight training arena.

The use of weight benches is known in the prior art. For example, U.S. Pat. No. 5,971,898 to Darrel Schoolfield discloses a sliding weight rack that uses linear bearings to retract the weight rack backwards so it is out of the way while the user completes his exercises but still accessible when the user is ready to replace the weights on the rack.

However, the Schoolfield '898 patent does not provide a sufficient arc in the receiving rests for the weights, and it is conceivable that the user could pull the weight from the receiving rests while attempting to move the weight bar forward, causing severe injury to the user. Additionally, the placement of the gas struts on the weight bar precludes the use of the bench for any sitting exercises in which the legs would straddle the bench.

U.S. Pat. No. 5,509,876 to Gilbert Reyes discloses a weight-bar support structure with retractable arms that uses a spring-loaded weight cradle for allowing the user to pull the weight forward to a more desirable position when removing it from the supports. The spring causes the supports to retract when the weight is removed from them. However, the Reyes '876 patent does not make any provision for the use of dumbbells in association with this structure. Furthermore, no indication is given in the Reyes '876 patent that additional supports can be added to the existing barbell supports for accomodating dumbbells.

Similarly, U.S. Pat. No. Des.399,543 to Clive Graham Stevens discloses the ornamental design for a multi-positional weightlifting bench that has a barbell support on either side of the head of the bench. However, the Stevens '543 patent does not include supports for positioning dumbbells for part of the weight training regimen, neither does it provide an attachment to provide supports for dumbbells. Furthermore, the Stevens '543 device has the barbell supports positioned behind the portion of the bench on which the user would place his head, which could cause undue stress on the shoulders when initially lifting the barbell from the support and when placing the barbell in the support at the conclusion of the exercise. Finally, the formation of the Stevens '543 device is such that a spotter can not reach the weight and support bars, rendering him useless to the weightlifter.

Likewise, U.S. Pat. No. 4,423,865 to Parker E. Mahnke discloses an exercise bench that provides a barbell support on either side of the bench. However, the Mahnke '865 patent does not provide supports that would be useful for holding dumbbells; thus the user would have to lift dumbbells from the floor, placing his shoulders and arms under an undue amount of stress. Additionally, only the top portion of the bench can be inclined in the Mahnke '865 device, reducing the amount of exercises which can be accomplished using the device. Finally, the Mahnke '865 patent makes no mention of attachments that can be added to the existing device in order to support other types of weights.

U.S. Pat. No. 4,635,934 to Siegfried Roethke discloses an exercise tower and bench that use multiple apertures in the frame to adjust the bench positioning and location in relation to the tower. However, the Roethke '934 patent is not freestanding and requires the fixed position support unit to be secured to a wall or other support member, thus reducing portability of the device. Additionally, the Roethke '934 patent makes no provision for dumbbell supports built into the tower, nor does it provide attachments which are able to support dumbbells. Finally, the Roethke '934 device is inconvenient to use and slows down a workout, requiring time between each exercise set to reconfigure the device.

Similarly, U.S. Pat. No. 5,147,260 to Andrew Roosevelt discloses a thoracic weightlifting bench that incorporates a curved portion of the bench wherein the user would lay his head and neck, thus providing the correct support to a weightlifter's back when performing the bench press. However, the Roosevelt '260 device is intended strictly for the bench press, and the curved bench precludes doing some exercises that require a flat bench. Additionally, the Roosevelt '260 device makes no provision for dumbbell supports, either as part of the bench or as attachments to the bench. Moreover, the bench in the Roosevelt '260 patent does not incline or decline, further limiting the number of exercises that can be performed with this device.

Lastly, U.S. Pat. No. 5,823,921 to Jeffrey S. Dawson discloses a free weight barbell lifting exercise machine with user controllable lift assist and safety device which employs a cable system operated by a pneumatic motor to apply an exponentially variable lifting force to the cable in response to linear movement of a foot pedal to replicate the function of a spotter. However, the Dawson '921 device is complex, driving up the cost of manufacture and resulting in higher costs to the consumer. Additionally, the Dawson '921 patent makes no provision for supporting dumbbells within the present invention.

While the above-described devices fulfill their respective, particular objectives and requirements, the aforementioned patents do not describe a weight bench with dumbbell supports that allows the user to safely execute a workout using both dumbbells and barbells from multiple positions of the bench. The Reyes '876, Stevens '543, Mahnke '865, Roethke '934, Roosevelt '260, and Dawson '921 patents make no provision for the use of dumbbells in association with the weight benches proffered in the patents, nor do the aforementioned patents indicate any support attachments which can be mounted on the existing bench to provide a support structure for dumbbells. Furthermore, the Schoolfield '898 device could be unsafe to use because it does not provide a sufficient arc in the receiving rests for the weights, and it is conceivable that the user could pull the weight from the receiving rests while attempting to move the weight bar forward, inflicting injury upon himself. The Stevens '543 device could also cause injury due to stress placed on the shoulders when the user reaches behind his head to place the barbell on the supports. The Schoolfield '898, Stevens '543, and Roosevelt '260 patents have structural limitations. The placement of the gas struts on the lower portion of the weight bar in the Schoolfield '898 device precludes the use of the bench for any sitting exercises in which the legs would straddle the bench, the formation of the Stevens '543 device is such that a spotter can not reach the weight and support bars, rendering him useless to the weightlifter, and the Roosevelt '260 device has a curved bench which precludes doing any exercises requiring a flat bench. The Mahnke '865 and Roosevelt '260 devices limit the number of exercises which can be performed because only the top portion of the bench can be inclined in the Mahnke '865 device and the bench in the Roosevelt '260 patent neither inclines nor declines. While the Roethke '934 patent allows multiple configurations of the bench, it is inconvenient to use and slows down a workout, requiring time between each exercise set to reconfigure the device. Moreover, the Roethke '934 device is not freestanding and requires the fixed position support unit to be secured to a wall or other support member, thus reducing portability of the device. Finally, the Dawson '921 device is complex, driving up the cost to manufacture and resulting in higher costs to the consumer.

Therefore, a need exists for a new and improved weight bench attachment that supports dumbbells and allows an existing weight bench to be safely used for a wider variety of exercises. In this regard, the present invention substantially fulfills this need. In this respect, the weight bench with dumbbell supports according to the present invention substantially departs from the conventional concepts and designs of the prior art, and in doing so provides an apparatus primarily developed for the purpose of providing a support structure for dumbbells on a new or existing weight bench, thereby decreasing the risk of injury to the weight lifter.

SUMMARY OF THE INVENTION

In view of the foregoing disadvantages inherent in the known types of weight benches now present in the prior art, the present invention provides an improved weight bench with dumbbell supports, and overcomes the above-mentioned disadvantages and drawbacks of the prior art. As such, the general purpose of the present invention, which will be described subsequently in greater detail, is to provide a new and improved weight bench with dumbbell supports which has all the advantages of the prior art mentioned heretofore and many novel features that result in a weight bench with dumbbell supports which is not anticipated, rendered obvious, suggested, or even implied by the prior art, either alone or in any combination thereof.

To attain this, the present invention essentially comprises a weight bench with a vertical support structure for barbells and a supplementary rack apparatus to be mounted on the vertical support structure wherein the rack apparatus consists of a pair of vertical support shafts having an angular lower leg and an elongated plate with angled ends for receiving a dumbbell or other free weight.

The supplementary rack apparatus could also be provided as an accessory for supporting dumbbells to be mounted on existing weight benches.

There has thus been outlined, rather broadly, the more important features of the invention in order that the detailed description thereof that follows may be better understood and in order that the present contribution to the art may be better appreciated.

The invention may also include a hinged weight bench that could be used in a flat, inclined, or declined position. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved weight bench with dumbbell supports that has all of the advantages of the prior art weight benches and none of the disadvantages.

It is another object of the present invention to provide a new and improved weight bench with dumbbell supports that may be easily and efficiently manufactured and marketed.

An even further object of the present invention is to provide a new and improved weight bench with dumbbell supports that has a low cost of manufacture with regard to both materials and labor, and which accordingly is then susceptible of low prices of sale to the consuming public, thereby making such a weight bench with dumbbell supports economically available to the buying public.

Still another object of the present invention is to provide a new weight bench with dumbbell supports that provides in the apparatuses and methods of the prior art some of the advantages thereof, while simultaneously overcoming some of the disadvantages normally associated therewith.

Even still another object of the present invention is to provide a weight bench with dumbbell supports for providing support for both dumbbell and barbell weights. This allows the weight bench to be used for weight training involving both dumbbells and barbells.

Yet another object of the present invention is to provide a weight bench with dumbbell supports which provides a safe method for initiating dumbbell exercises. This allows the weight trainer to initiate dumbbell exercises from the weight bench without placing undue stress on shoulders and arm that would occur if dumbbells were lifted from the floor.

Lastly, it is an object of the present invention to provide a new and improved set of dumbbell supports which can be attached to an existing weight bench. This allows the user to add dumbbell exercises to the weight training regimen without purchasing a new weight bench.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
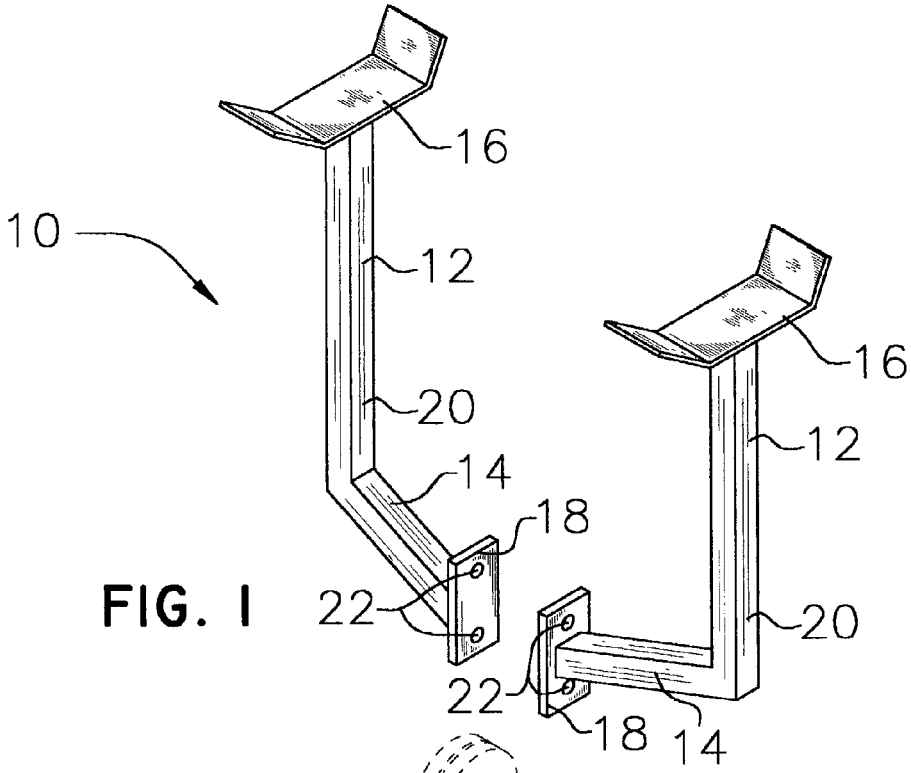
FIG. 1 is a side perspective view of the preferred embodiment of the dumbbell supports for a weight bench constructed in accordance with the principles of the present invention.
Figure 2:
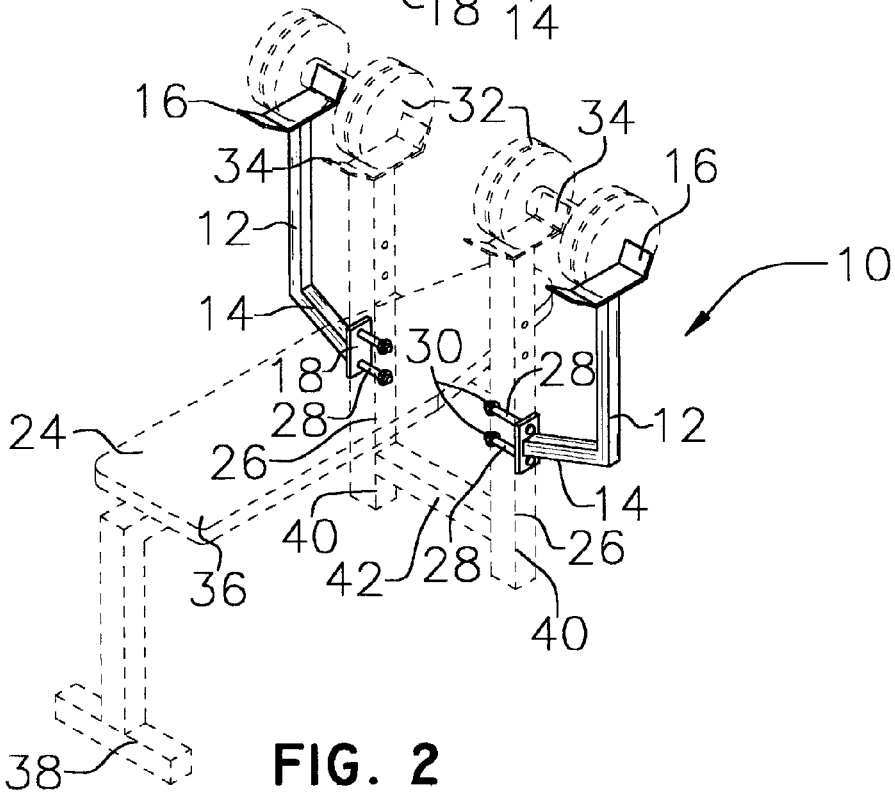
FIG. 2 is a side perspective view of the dumbbell supports mounted on a weight bench.

Referring now to the drawings, and particularly to FIGS. 1–2, a preferred embodiment of the dumbbell supports for a weight bench of the present invention is shown and generally designated by the reference numeral 10.

In FIG. 1, a pair of new and improved dumbbell supports for a weight bench 10 of the present invention for providing extra functionality to a new or existing weight bench is illustrated and will be described. More particularly, the dumbbell support for a weight bench 10 has a vertical shaft 12 made of square steel tubing with an angular lower leg 14. A holding plate 16 is mounted on the upper end of the vertical shaft 12. The holding plate 16 is angled or bent upward to securely hold the end of a dumbbell. At the end of the angular lower leg 14 is a mounting bracket 18. The mounting bracket 18 is parallel to the main portion 20 of the vertical support shaft and contains two mounting holes 22.

FIG. 2 shows a side perspective view of the dumbbell supports 10 mounted on an existing weight bench 24. The lower leg 14 of each dumbbell support 10 is angled for attachment to the exterior of the weight bench's existing vertical supports 26. A pair of holes would need to be drilled into each vertical support 26 for the dumbbell supports to be mounted. A bolt 28 would be inserted through the each mounting hole 22 in the mounting bracket 18 of the dumbbell support 10, passed through the corresponding hole in the vertical support 26, and fastened with a nut 30. The main portion 20 of each dumbbell support 10 would measure approximately 18 inches in height and feature a 3/16 inch thick, 7½ inch wide metal holding plate 16 at its top. The ends of the plate 16 are angled upwards to securely hold a dumbbell 32 and would be positioned approximately 5¼ inches away from the original weight bar holders 34 on the bench 24. Ultimately, a weight bench 24 with two dumbbell supports 10 incorporated into its design would feature four weight bar holders, an original weight bar holder 34 and a dumbbell support 10 on each side for holding dumbbells.

FIG. 2 could also depict the dumbbell supports 10 as part of a new weight bench 24. Produced primarily from square steel tubing, the weight bench with dumbbell supports would essentially consist of a traditional weight bench 24, featuring a padded bench area 36 supported by a "T"-shaped front foot 38 and dual rear legs 40 supported by a horizontal cross bar 42. Extending upwards from the legs would be vertical supports 26 with curved, or angled, metal weight bar holders 34 at the top to accommodate a long weight bar. In this configuration, each dumbbell support 10 would be welded to the exterior of one of the bench's vertical supports 26, thereby creating a solid, one-piece support featuring a forked design on each side of the bench 24. The bench portion of the unit would likely feature a hinged design and could thus be raised and lowered for different exercises. Like conventional weight benches 24, the bench 24 could be secured at various heights using a steel rod and nut, which could be placed through holes on the vertical supports and secured.

In use, it can now be understood that an individual would mount each dumbbell support on an existing weight bench by securing a bolt through the mounting bracket of the dumbbell support and through the mounting hole in the existing vertical support and fastening a nut on the other end. The weight bench might also be purchased with the dumbbell supports permanently attached. The user would simply adjust the bench according to the exercise he or she wishes to perform. The individual would the place a pair of dumbbells in the dual holders at the top of the supports, lie on the bench, and then lift the dumbbells from between the two holders. Used in this manner, the weight bench with dumbbell supports would enable the user to lift dumbbells in the same manner as lifting a barbell from a weight bench. This would make starting exercises easier and safer, particularly when using heavier dumbbells.

While a preferred embodiment of the weight bench with dumbbell supports has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as metal or a variety of wood may be used instead of the steel tubing described. Also, the metal support plates may also be made of wood or similar material, and they could be curved upward instead of being angularly bent on the ends. And although providing the ability to support dumbbell weights on a conventional weight bench has been described, it should be appreciated that the weight bench with dumbbell supports herein described is also suitable for supporting barbells and other types of free weights.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A weight bench with dumbbell supports comprising:

a flat, elongated bench having a top surface, a bottom surface, a head, and a foot;

an elongated bench support having a first horizontal portion, a second vertical portion with a top end and a bottom end wherein said top end of said second vertical portion extends perpendicularly downward from said first horizontal portion, and a T-shaped foot extending horizontally from said bottom end of said second vertical portion and connected to said bottom surface of said bench wherein said horizontal portion is parallel to the longitudinal axis of said bench;

a vertical support assembly having a first vertical leg with a top, a bottom, an outer face, and an inner face, a second vertical leg parallel to said first vertical leg and having a top, a bottom, an outer face, and an inner face wherein said inner face of said second vertical leg faces said inner face of said first vertical leg, a lower horizontal rung perpendicular to said first vertical leg and joining said inner face of said first vertical leg to said inner face of said second vertical leg, and an upper horizontal rung having a top surface and a bottom surface and parallel to said lower horizontal rung and joining said inner face of said first vertical leg to said inner face of said second vertical leg and connected on said top surface of said upper horizontal rung to said bottom surface of said bench wherein said bottom surface of said bench resides on said top surface of said upper horizontal rung but is not permanently affixed to said top surface of said upper horizontal rung;

a first dumbbell support connected to said first vertical leg of said vertical support assembly;

a second dumbbell support connected to said second vertical leg of said vertical support assembly;

a first weight rest connected to said top of said first vertical leg of said vertical support assembly; and a second weight rest connected to said top of said second vertical leg of said vertical support assembly;

wherein said first dumbbell support and said second dumbbell support are formed with a vertical shaft having a top vertical portion with a top end and a bottom end and an angular lower leg portion with a first end joined to said bottom end of said top vertical portion and a second end and further comprise:

a first dumbbell weight receptor connected to said top end of said vertical shaft of said first dumbbell support; and a second dumbbell weight receptor connected to said top end of said vertical shaft of said second dumbbell support;

wherein said first dumbbell weight receptor and said second dumbbell weight receptor are elongated plates having a first end, a middle, and a second end wherein said middle is horizontal and perpendicular to said top end of said vertical shaft of said first and said second dumbbell support, respectively, and said first end is angled upward, and said second end is angled upward; and wherein said first dumbbell support further comprises:

a flat mounting bracket formed with a plurality of transverse apertures and connected to said second end of said lower leg portion;

a plurality of fastening bolts connected to said first dumbbell support wherein said bolts pass through said transverse apertures in said mounting bracket and through said transverse apertures in said first vertical leg of said vertical support assembly; and a plurality of nuts connected to said bolts wherein one said nut is connected to each said bolt.

2. A weight bench with dumbbell supports comprising:

a flat, elongated bench having a top surface, a bottom surface, a head, and a foot;

an elongated bench support having a first horizontal portion, a second vertical portion with a top end and a bottom end wherein said top end of said second vertical portion extends perpendicularly downward from said first horizontal portion, and a T-shaped foot extending horizontally from said bottom end of said second vertical portion and connected to said bottom surface of said bench wherein said horizontal portion is parallel to the longitudinal axis of said bench;

a vertical support assembly having a first vertical leg with a top, a bottom, an outer face, and an inner face, a second vertical leg parallel to said first vertical leg and having a top, a bottom, an outer face, and an inner face wherein said inner face of said second vertical leg faces said inner face of said first vertical leg, a lower horizontal rung perpendicular to said first vertical leg and joining said inner face of said first vertical leg to said inner face of said second vertical leg, and an upper horizontal rung having a top surface and a bottom surface and parallel to said lower horizontal rung and joining said inner face of said first vertical leg to said inner face of said second vertical leg and connected on said top surface of said upper horizontal rung to said bottom surface of said bench wherein said bottom surface of said bench resides on said top surface of said upper horizontal rung but is not permanently affixed to said top surface of said upper horizontal rung;

a first dumbbell support connected to said first vertical leg of said vertical support assembly;

a second dumbbell support connected to said second vertical leg of said vertical support assembly;

a first weight rest connected to said top of said first vertical leg of said vertical support assembly; and a second weight rest connected to said top of said second vertical leg of said vertical support assembly;

wherein said first dumbbell support and said second dumbbell support are formed with a vertical shaft having a top vertical portion with a top end and a bottom end and an angular lower leg portion with a first end joined to said bottom end of said top vertical portion and a second end and further comprise:

a first dumbbell weight receptor connected to said top end of said vertical shaft of said first dumbbell support; and a second dumbbell weight receptor connected to said top end of said vertical shaft of said second dumbbell support;

wherein said first dumbbell weight receptor and said second dumbbell weight receptor are elongated plates having a first end, a middle, and a second end wherein said middle is horizontal and perpendicular to said top end of said vertical shaft of said first and said second dumbbell support, respectively, and said first end is angled upward, and said second end is angled upward; and wherein said second dumbbell support further comprises:

a flat mounting bracket formed with a plurality of transverse apertures and connected to said second end of said lower leg portion;

a plurality of fastening bolts connected to said second dumbbell support wherein said bolts pass through said transverse apertures in said mounting bracket and through said transverse apertures in said second vertical leg of said vertical support assembly; and a plurality of nuts connected to said bolts wherein one said nut is connected to each said bolt.

* * * * *